US011108145B2

(12) United States Patent
Sudo et al.

(10) Patent No.: US 11,108,145 B2
(45) Date of Patent: Aug. 31, 2021

(54) ANTENNA MODULE AND COMMUNICATION DEVICE PROVIDED WITH THE SAME

(71) Applicant: Murata Manufacturing Co., Ltd., Kyoto (JP)

(72) Inventors: Kaoru Sudo, Kyoto (JP); Hirotsugu Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/002,319

(22) Filed: Aug. 25, 2020

(65) Prior Publication Data

US 2020/0388912 A1 Dec. 10, 2020

Related U.S. Application Data

(63) Continuation of application No. PCT/JP2019/010840, filed on Mar. 15, 2019.

(30) Foreign Application Priority Data

Mar. 30, 2018 (JP) ..... JP2018-070043

(51) Int. Cl.
*H01Q 1/38* (2006.01)
*H01Q 5/378* (2015.01)
(Continued)

(52) U.S. Cl.
CPC ..... *H01Q 1/38* (2013.01); *H01Q 3/26* (2013.01); *H01Q 5/378* (2015.01);
(Continued)

(58) Field of Classification Search
CPC ..... H01Q 1/38; H01Q 3/26; H01Q 5/378; H01Q 9/0421; H01Q 13/08; H01Q 21/06; H01Q 23/00
See application file for complete search history.

(56) References Cited

U.S. PATENT DOCUMENTS 4,401,988 A * 8/1983 Kaloi ..... H01Q 19/005 343/700 MS
9,692,127 B2 * 6/2017 Yamagajo ..... H01Q 5/307
(Continued)

FOREIGN PATENT DOCUMENTS

JP 2004312533 A 11/2004
JP 2006261800 A 9/2006
(Continued)

OTHER PUBLICATIONS

International Search Report issued in Application No. PCT/JP2019/010840, dated Jun. 4, 2019.
(Continued)

*Primary Examiner* — Hoang V Nguyen
(74) *Attorney, Agent, or Firm* — Pearne & Gordon LLP

(57) ABSTRACT

The antenna module includes a dielectric substrate having a multilayer structure, a feed element to which radio frequency power is supplied, a ground electrode (GND), a parasitic element disposed in a layer between the feed element and the ground electrode (GND), and a feed wire. The feed wire penetrates through the parasitic element, and supplies radio frequency power to the feed element. When the antenna module is viewed in a plan view from a normal direction of the dielectric substrate, at least part of the feed element overlaps with the parasitic element, and a first position (P1) at which the feed wire is connected to the feed element is different from a second position (P2) at which the feed wire reaches the layer in which the parasitic element is disposed from a side of the ground electrode (GND).

12 Claims, 8 Drawing Sheets

(51) Int. Cl.

| | |
|---|---|
| ***H01Q 3/26*** | (2006.01) |
| ***H01Q 9/04*** | (2006.01) |
| ***H01Q 13/08*** | (2006.01) |
| ***H01Q 21/06*** | (2006.01) |

(52) U.S. Cl.
CPC ..... *H01Q 9/0421* (2013.01); *H01Q 13/08* (2013.01); *H01Q 21/06* (2013.01)

(56) References Cited

U.S. PATENT DOCUMENTS

| | | | |
|---|---|---|---|
| 10,193,222 | B2 | 1/2019 | Mizunuma et al. |
| 2004/0201523 | A1 | 10/2004 | Yuanzhu |
| 2008/0088510 | A1 | 4/2008 | Murata et al. |
| 2015/0333407 | A1 | 11/2015 | Yamagajo et al. |

FOREIGN PATENT DOCUMENTS

| | | | |
|---|---|---|---|
| JP | 2007037109 | A | 2/2007 |
| JP | 2011155479 | A | 8/2011 |
| JP | 2012147243 | A | 8/2012 |
| JP | 2015216577 | A | 12/2015 |
| WO | 2016063759 | A1 | 4/2016 |

OTHER PUBLICATIONS

Written Opinion issued in Application No. PCT/JP2019/010840, dated Jun. 4, 2019.

* cited by examiner

ANTENNA MODULE AND COMMUNICATION DEVICE PROVIDED WITH THE SAME

This is a continuation of International Application No. PCT/JP2019/010840 filed on Mar. 15, 2019 which claims priority from Japanese Patent Application No. 2018-070043 filed on Mar. 30, 2018. The contents of these applications are incorporated herein by reference in their entireties.

BACKGROUND

Technical Field

The present disclosure relates to an antenna module and a communication device provided with the antenna module, and more specifically, to a technique for improving characteristics of an antenna module capable of performing radiation in two frequency bands.

An antenna module in which a feed element and a radio frequency semiconductor device are integrated and mounted on a dielectric substrate is disclosed in International Publication No. 2016/063759 (Patent Document 1). Further, Patent Document 1 discloses a configuration in which a parasitic element is further provided. The parasitic element is not supplied with power from a radio frequency semiconductor device and is electromagnetically coupled to a feed element. Generally, it has been known that a parasitic element is provided to achieve a wider band antenna.

Patent Document 1: International Publication No. 2016/063759

BRIEF SUMMARY

In recent years, mobile terminals, such as smartphones have become popular, and in addition, home appliances and electronic apparatus having a wireless communication function have been increasing because of technological innovation, such as IoT. Accordingly, there is a concern that the communication traffic in a wireless network increases, and communication speed and communication quality decrease.

As one countermeasure for solving such an issue, development of the fifth generation mobile communication system (5G) has been progressing. In the 5G, it is intended to achieve an increase in communication speed and an improvement in communication quality by performing advanced beamforming and spatial multiplexing using a large number of feed elements, and by using signals in a millimeter-wave band having a higher frequency (tens of GHz) in addition to signals in 6 GHz frequency band which have been used from the past.

In the 5G, there is a case where frequencies in a plurality of millimeter-wave bands that are separated frequency bands are used, and in this case, it is required to transmit and receive signals in the plurality of frequency bands by one antenna.

The present disclosure provides an antenna module capable of transmitting and receiving signals in a plurality of frequency bands.

An antenna module according to the present disclosure includes a dielectric substrate having a multilayer structure, a feed element that is disposed in the dielectric substrate and supplied with radio frequency power, a ground electrode disposed in the dielectric substrate, a parasitic element disposed in a layer between the feed element and the ground electrode, and a first feed wire. The first feed wire penetrates through the parasitic element, and supplies radio frequency power to the feed element. When the antenna module is viewed in a plan view from the normal direction of the dielectric substrate, (i) at least part of the feed element overlaps with the parasitic element, and (ii) a first position at which the first feed wire is connected to the feed element is different from a second position at which the first feed wire reaches the layer in which the parasitic element is disposed from a side of the ground electrode.

When the antenna module is viewed in a plan view from the normal direction of the dielectric substrate, the first position can be shifted toward the outer side direction of the parasitic element relative to the second position.

When the antenna module is viewed in a plan view from the normal direction of the dielectric substrate, the first position can be shifted toward the inner side direction of the parasitic element relative to the second position.

The first feed wire can be offset in the layer in which the parasitic element is disposed.

The first feed wire can be offset in a layer between the parasitic element and the feed element.

The area of the feed element can be smaller than the area of the parasitic element. When the antenna module is viewed in a planar view from the normal direction of the dielectric substrate, the feed element is disposed inside the parasitic element.

The antenna module can further include a power feeding circuit that is mounted on the dielectric substrate and supplies radio frequency power to the feed element.

The antenna module can further include at least one stub connected to the first feed wire between the parasitic element and the power feeding circuit.

The antenna module can further include a second feed wire that penetrates through the parasitic element and supplies radio frequency power to the feed element. When the antenna module is viewed in a plan view from the normal direction of the dielectric substrate, a third position at which the second feed wire is connected to the feed element is different from a fourth position at which the second feed wire reaches the layer in which the parasitic element is disposed from the side of the ground electrode.

When the antenna module is viewed in a plan view from the normal direction, (i) the first position can be shifted toward the outer side direction of the parasitic element relative to the second position, and (ii) the third position can be shifted toward the outer side direction of the parasitic element relative to the fourth position.

A communication device according to another aspect of the present disclosure includes the antenna module described in any of the above.

With respect to the present disclosure, in an antenna module including a feed element and a parasitic element, a position at which a feed wire rises from the power feeding circuit (RFIC: Radio Frequency Integrated Circuit) to a layer of the parasitic element and a position at which the feed wire is connected to the feed element are shifted from each other. This makes it possible to individually adjust impedance at the frequency of a signal radiated by the feed element and impedance at the frequency of a signal radiated by the parasitic element. Thus, it is possible to transmit and receive a signal in the frequency band for each of the feed element and the parasitic element.

DETAILED DESCRIPTION

Figure 1:
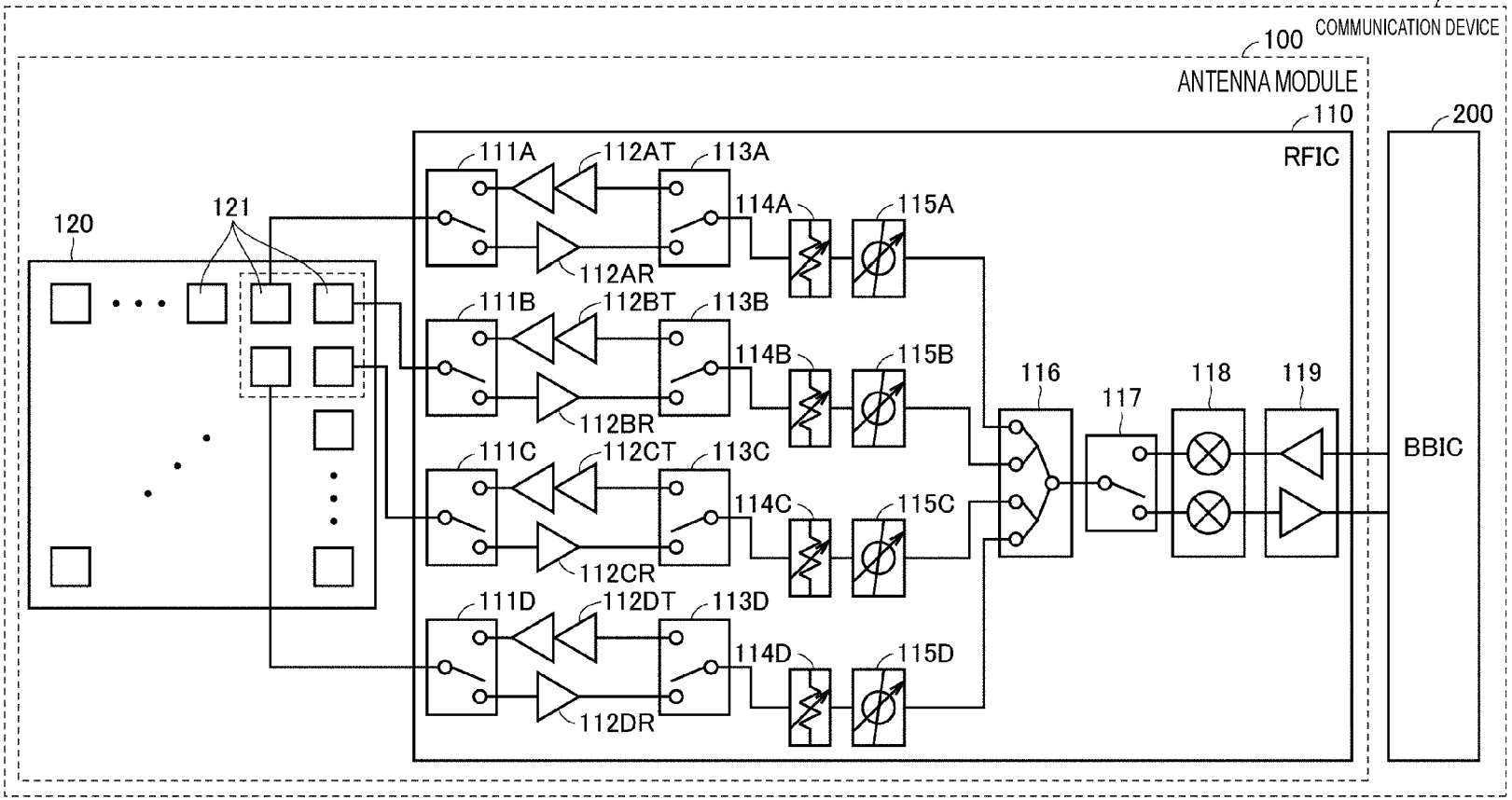
FIG. 1 is a block diagram of a communication device to which an antenna module according to Embodiment 1 is applied.

Hereinafter, embodiments of the present disclosure will be described in detail with reference to the accompanying drawings. Note that the same or corresponding portions in the drawings are denoted by the same reference numerals, and the description thereof will not be repeated.

Embodiment 1

(Basic Configuration of Communication Device)

FIG. 1 is a block diagram illustrating an example of a communication device 10 to which an antenna module 100 according to present Embodiment 1 is applied. The communication device 10 is, for example, a mobile terminal, such as a mobile phone, a smartphone, or a tablet, a personal computer having a communication function, or the like.

According to FIG. 1, the communication device 10 includes the antenna module 100 and a BBIC 200 that constitutes a baseband signal processing circuit. The antenna module 100 includes an RFIC 110, which is an example of a power feeding circuit, and an antenna array 120. The communication device 10 up-converts a signal transferred from the BBIC 200 to the antenna module 100 into a radio frequency signal and radiates the signal from the antenna array 120. The communication device 10 down-converts the radio frequency signal received by the antenna array 120 and processes the signal in the BBIC 200.

Note that, in FIG. 1, for ease of description, among a plurality of feed elements 121 configuring the antenna array 120, only a configuration corresponding to the four feed elements 121 is illustrated, and configurations corresponding to other feed elements 121 that have the same configuration are omitted. In the present embodiment, a case where the feed element 121 is a patch antenna having a rectangular flat plate shape will be described as an example.

The RFIC 110 includes switches 111A to 111D, 113A to 113D, and 117, power amplifiers 112AT to 112DT, low-noise amplifiers 112AR to 112DR, attenuators 114A to 114D, phase shifters 115A to 115D, a combiner/divider 116, a mixer 118, and an amplifier 119.

When transmitting a radio frequency signal, the switches 111A to 111D and 113A to 113D are switched to the power amplifiers 112AT to 112DT side, and the switch 117 is connected to the transmission-side amplifier in the amplifier 119. When a radio frequency signal is received, the switches 111A to 111D and 113A to 113D are switched to the low-noise amplifiers 112AR to 112DR side, and the switch 117 is connected to the reception-side amplifier in the amplifier 119.

A signal transferred from the BBIC 200 is amplified by the amplifier 119, and is up-converted by the mixer 118. A transmission signal, which is an up-converted radio frequency signal, is divided into four waves by the signal combiner/divider 116. The waves pass through four signal paths, and are supplied to the feed elements 121 different from one another. At this time, the directivity of the antenna array 120 may be adjusted by individually adjusting the phase shift in the phase shifters 115A to 115D disposed in the respective signal paths.

Reception signals which are the radio frequency signals received by the feed elements 121 respectively go through four different signal paths and are combined by the signal combiner/divider 116. The combined received signal is down-converted by the mixer 118, amplified by the amplifier 119, and transferred to the BBIC 200.

The RFIC 110 is formed as, for example, a single chip integrated circuit component including the above-described circuit configuration. Alternatively, devices (switch, power amplifier, low-noise amplifier, attenuator, and phase shifter) supporting each feed element 121 in the RFIC 110 may be formed as a single chip integrated circuit component for each corresponding feed element 121.

(Structure of Antenna Module)

Figure 2:
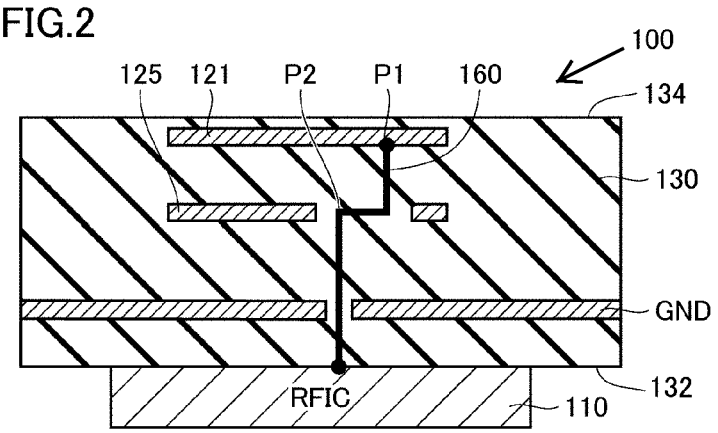
FIG. 2 is a cross-sectional view of the antenna module according to Embodiment 1.
Figure 3:
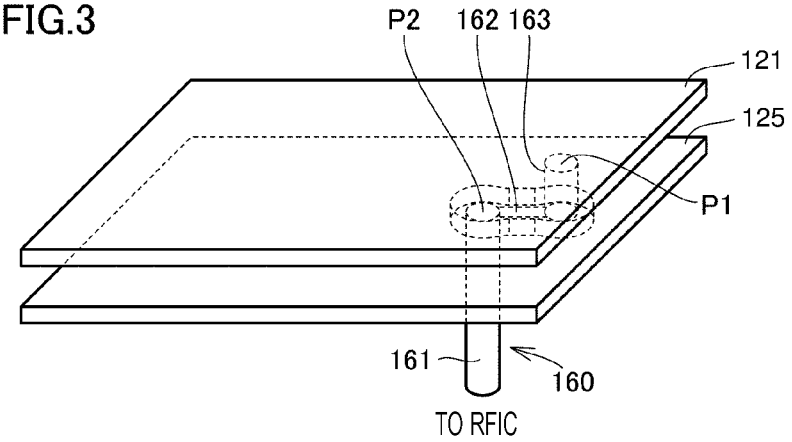
FIG. 3 is a perspective view for describing positions of a feed element and a feed wire in the antenna module in FIG. 2.

The structure of the antenna module 100 will be described with reference to FIG. 2 and FIG. 3. FIG. 2 is a cross-sectional view of the antenna module 100, and FIG. 3 is a perspective view for describing positions of the feed element 121, a parasitic element 125, and a feed wire 160.

According to FIG. 2, the antenna module 100 includes a dielectric substrate 130, a ground electrode GND, and the parasitic element 125, in addition to the feed element 121 and the RFIC 110. Note that, in FIG. 2, a description will be given of a case where only one feed element 121 is disposed for ease of description, but a configuration in which the plurality of feed elements 121 are disposed may be employed. Further, in FIG. 3, to facilitate understanding, only the feed element 121, the parasitic element 125, and the feed wire 160 are described, and the description of the dielectric substrate 130 and the RFIC 110 is omitted. In addition, in the following description, the feed element and the parasitic element are collectively referred to as a "radiating element".

The dielectric substrate 130 is, for example, a substrate in which a resin, such as epoxy or polyimide is formed in a multilayer structure. Further, the dielectric substrate 130 may be formed using a liquid crystal polymer (LCP) having further lower permittivity or a fluorine-based resin.

The feed element 121 is disposed on a first surface 134 of the dielectric substrate 130 or in the inner layer of the dielectric substrate 130. The RFIC 110 is mounted on a second surface (mounting surface) 132 in the side opposite to the above-described first surface 134 of the dielectric substrate 130 using a connection electrode, such as a solder bump or the like (not illustrated). The ground electrode GND is disposed between the layer in which the feed element 121 is disposed and the second surface 132 in the dielectric substrate 130.

The parasitic element 125 is disposed in a layer between the feed element 121 and the ground electrode GND so as to face the feed element 121 in the dielectric substrate 130. The parasitic element 125 overlaps with at least part of the feed element 121 when the antenna module 100 is viewed in a plan view from the normal direction of the first surface 134 of the dielectric substrate 130. In FIG. 2 and FIG. 3, although illustrated is an example in which the feed element 121 and the parasitic element 125 have substantially the same size, the feed element 121 and the parasitic element 125 may have different sizes, as will be described later with reference to FIG. 10 and the like.

The feed wire 160 is originated from the RFIC 110, penetrates through the ground electrode GND and the parasitic element 125, and is connected to the feed element 121. In more detail, as illustrated in FIG. 3, the feed wire 160 rises up using a via 161 from the RFIC 110 to the layer in which the parasitic element 125 is disposed. The feed wire 160 is offset by a wiring pattern 162 in the outer side direction of the parasitic element 125 in the layer, and further rises from there to the feed element 121 using a via 163. Here, a connection position P1 of the via 163 and the feed element 121 is referred to as a "first position", and a connection position P2 of the via 161 and the wiring pattern 162 in the layer in which the parasitic element 125 is disposed is also referred to as a "second position". As described above, the feed wire 160 reaching the layer in which the parasitic element 125 is disposed turns to the outer side direction of the parasitic element 125 at the connection position P2, further turns to the direction of the feed element 121 at the position immediately below the connection position P1, and is connected to the feed element 121.

Note that the feed wire 160 is not limited to a wire which is linearly disposed from the RFIC 110 to the layer in which the parasitic element 125 is formed as illustrated in FIG. 2. For example, the feed wire 160 may turn before reaching the layer in which the parasitic element 125 is formed from the RFIC 110. That is, the "second position" described above is a position where the feed wire 160 reaches the layer in which the parasitic element 125 is formed from the ground electrode GND side.

In the past, there has been known a technology to widen a frequency band in which transmission and reception are performed by providing a feed element with a parasitic element. This is based on the fact that the return loss decreases at the frequency between the resonant frequency of the feed element and the resonant frequency of the parasitic element.

In the case of using the parasitic element, in general, the parasitic element is disposed on a side in which a radio wave is radiated relative to the feed element. In this case, since the impedance of the parasitic element is fixed, the return loss at the resonant frequency of the parasitic element also becomes constant.

On the other hand, for the feed element, it has been known that the impedance of the feed element changes by changing the feeding position, and the antenna characteristics change as the result.

Specifically, by making the impedance of the feed element approach the characteristic impedance of the circuit (for example, 50Ω or 75Ω), the impedance sharply decreases in a narrow band near the resonant frequency of the feed element. Therefore, although the return loss in the region very close to the resonant frequency decreases, the return loss in the neighboring frequency of the region becomes a relatively large value. On the contrary, when the impedance of the feed element is shifted from the characteristic impedance, the return loss at the resonant frequency increases. However, since the impedance at the vicinity of the resonant frequency decreases slowly, the return loss exhibits a gradually decreasing characteristic accordingly.

In other words, in a graph describing a reflection characteristic, when the impedance of the feed element is close to the characteristic impedance, the valley (decreasing amount of loss) at the resonant frequency becomes narrow and deep, and when the impedance is shifted from the characteristic impedance, the valley becomes shallow and wide. That is, the decreasing amount of loss (valley depth) and the band width (valley width) in which the loss decreases are in a trade-off relationship. Therefore, when the impedance of the feed element is shifted from the characteristic impedance, the region in which the return loss decreases becomes apparently wider, and the widening of the frequency band may be achieved depending on the target of the required loss.

In addition, inventors of the present disclosure have found that the impedance of the parasitic element may be changed as in the case of the feed element by causing the feed wire supplying power to the feed element to penetrate through the parasitic element and by changing the penetrating position. Then, in the present embodiment, as described in FIG. 2 and FIG. 3, it is determined that when the antenna module is viewed in a plan view from the normal direction of the dielectric substrate, the position at which the feed wire rises up to the layer in which the parasitic element is formed ("second position P2" in FIG. 2) and the feed point position at which the feed wire is connected to the feed element ("first position P1" in FIG. 2) are different from each other. With the configuration above, by appropriately adjusting the first position P1 and the second position P2, it is possible to individually adjust the band width around the resonant frequency of the feed element and the band width around the resonant frequency of the parasitic element.

Figure 4:
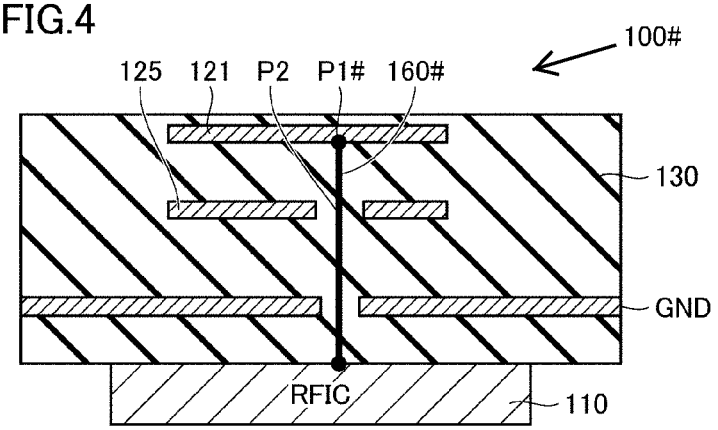
FIG. 4 is a cross-sectional view of an antenna module of Comparative Example 1.

Next, the change in the return loss due to the presence or absence of the offset between the first position P1 and the second position P2 will be described with reference to comparative examples. FIG. 4 is a cross-sectional view of the antenna module 100 # of Comparative Example 1, and FIG. 5 is a perspective view for describing the positions of the radiating elements and the feed wire in the antenna module 100 #.

Figure 5:
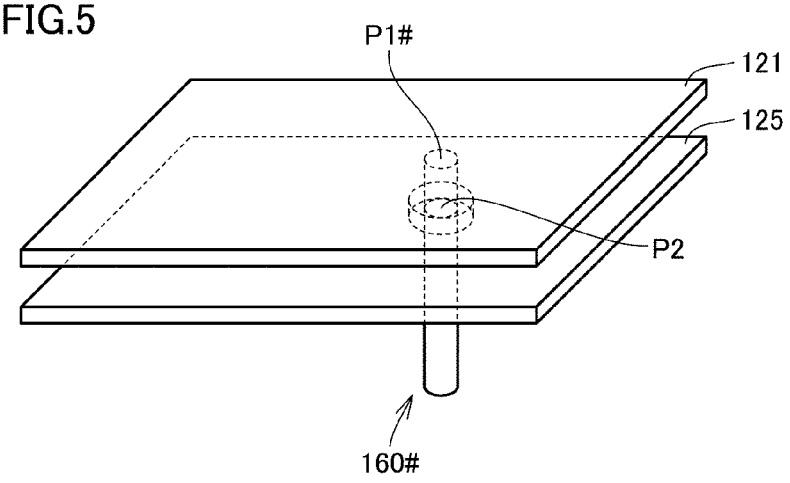
FIG. 5 is a perspective view for describing positions of a radiating element and a feed wire in the antenna module of Comparative Example 1 in FIG. 4.

In Comparative Example 1, the feed wire 160 # is not offset in the middle, and as illustrated in FIG. 5, when the antenna module 100 # is viewed in a plan view from the normal direction of the dielectric substrate 130, the feed point of the feed element 121 (first position P1 #) and the penetration position through the parasitic element 125 (second position P2) overlap with each other.

Figure 6:
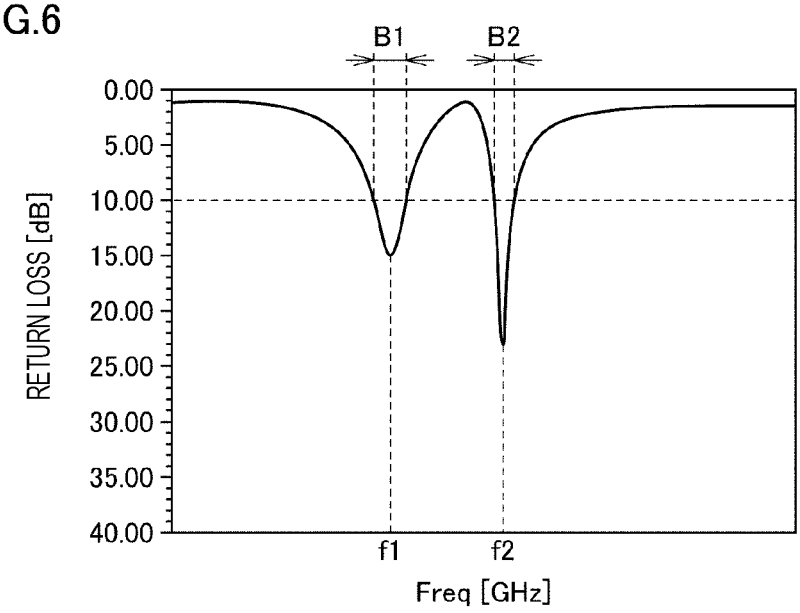
FIG. 6 is a diagram describing an example of a reflection characteristic of the antenna module of Comparative Example 1.
Figure 7:
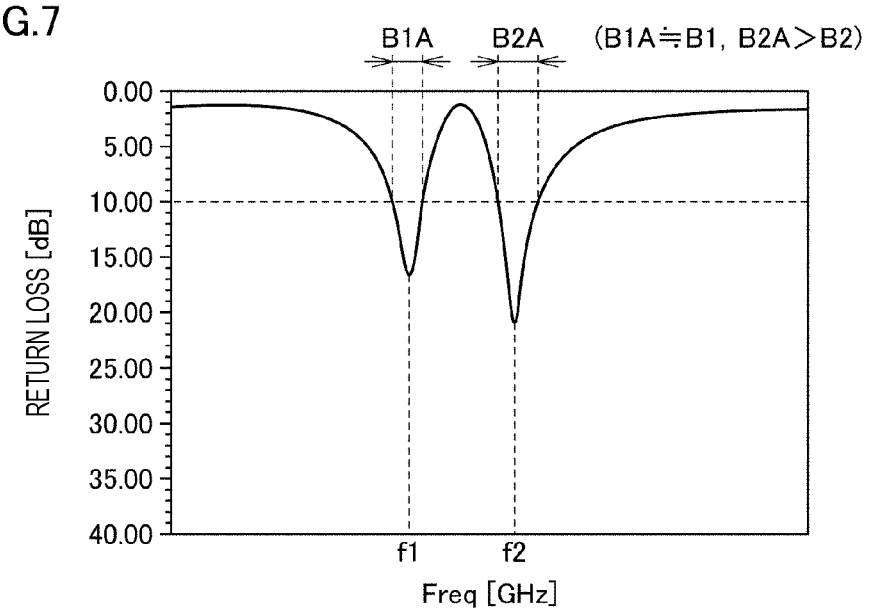
FIG. 7 is a diagram describing an example of a reflection characteristic of the antenna module of Embodiment 1.

A simulation result of reflection characteristic of the antenna module 100 # of Comparative Example 1 is described in FIG. 6, and a simulation result of reflection characteristic of the antenna module 100 of present Embodiment 1 in FIG. 2 is described in FIG. 7. In FIG. 6 and FIG. 7, the horizontal axis represents frequency, and the vertical axis represents reflection loss (return loss) for the antenna modules 100 and 100 #. The larger the return loss is, the less likely the signal is radiated, and the smaller the return loss is, the more likely the signal is radiated.

In the simulation of FIG. 6 and FIG. 7, sizes of respective elements in the antenna module 100 of Embodiment 1 and in the antenna module 100 # of Comparative Example 1 are substantially the same, the frequency f1 is the resonant frequency of the parasitic element 125, and the frequency f2 is the resonant frequency of the feed element 121.

In Comparative Example 1, the feed point in the feed element 121 (first position P1 #) is set to the position (optimum position) at which the impedance becomes the characteristic impedance (50Ω). In FIG. 6, the return loss is approximately 23 dB at the resonant frequency f2 of the feed element 121.

On the other hand, the feed point in the antenna module 100 of Embodiment 1 (first position P1) is placed at the shifted position toward the outer side direction of the parasitic element 125 relative to the feed point P1 # in Comparative Example 1 (optimum position). Because of this, as described in FIG. 7, the return loss is decreased to approximately 21 dB at the resonant frequency f2 of the feed element 121.

Here, in a case where the target of the return loss (allowable range) is set to 10 dB or less, in Comparative Example 1, the band width becomes B2 which achieves the target in the vicinity of the frequency f2, and in Embodiment 1, the band width becomes the pass band width B2A which is wider than B2 (B2<B2A). Therefore, in the antenna module 100 of Embodiment 1, although the return loss at the resonant frequency f2 of the feed element 121 is slightly decreased, the band width with which the target return loss may be achieved is widened.

Note that, in the parasitic element 125, in both of the antenna modules 100 and 100 #, since the penetration positions P2 of the feed wires are the same, values of the impedance in FIG. 6 and FIG. 7 are substantially the same. Therefore, the return loss of the antenna module 100 and the return loss of the antenna module 100 # at the resonant frequency f1 of the parasitic elements 125 have substantially the same magnitude, and the pass band widths B1 and B1A that may achieve the target return loss have substantially the same width.

As described above, in the dielectric substrate 130, the parasitic element 125 is disposed closer to the ground electrode GND relative to the feed element 121, the feed wire 160 is caused to penetrate through the parasitic element 125 and is further offset and connected to the feed element 121, whereby the pass band width of the radio frequency signal in the vicinity of the resonant frequency of each element may individually be adjusted.

Note that, in the above description, for ease of description, the penetration positions P2 of the feed wire in the parasitic element 125 are in the same position. However, it is possible to further adjust the pass band width of the radio frequency signal near the resonant frequency f1 of the parasitic element 125 by shifting the penetration position P2 with the change of the rising path of the feed wire from the RFIC 110 to the parasitic element 125.

(Modification 1)

In the antenna module 100 of Embodiment 1 illustrated in FIG. 2, the configuration is described in which the feed wire turns toward the outer side direction of the parasitic element 125, and the first position (feed point) P1 is shifted toward the outer side direction of the parasitic element 125 relative to the second position P2 in the cross-sectional view. However, in the adjustment of the pass band width, the offset direction of the feed wire is not limited to the above.

Figure 8:
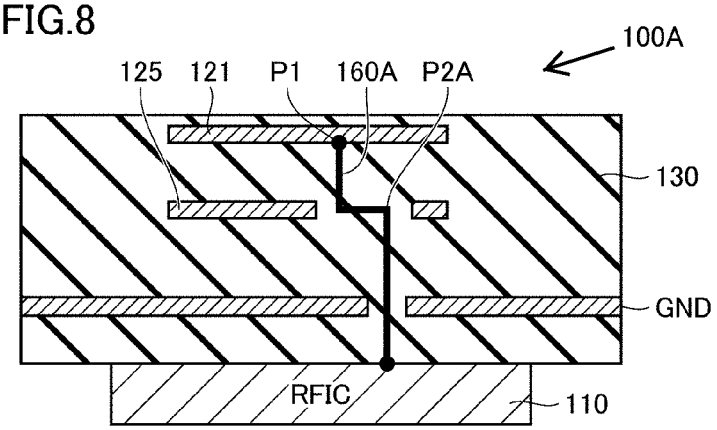
FIG. 8 is a cross-sectional view of an antenna module according to Modification 1.

In an antenna module 100A of Modification 1 illustrated in FIG. 8, a feed wire 160A turns toward the inner side direction of the parasitic element 125, and the first position P1 is shifted toward the inner side direction of the parasitic element 125 relative to the second position P2A in the cross-sectional view.

For example, when it is desired to adjust the band width of the parasitic element 125 from the state of the antenna module 100 # of Comparative Example 1 illustrated in FIG. 4, by disposing the second position P2A in the outer side direction relative to the first position P1, it is possible to make the first position P1 be shifted toward the inner side direction of the parasitic element 125 relative to the second position P2A as a consequence.

The offset direction of the feed wire may appropriately be set depending on the element of which pass band width is to be adjusted.

(Modification 2)

In Embodiment 1 and Modification 1, the feed wire is offset in the layer in which the parasitic element 125 is formed. In these configurations, it is possible to reduce the number of layers in the dielectric substrate.

Figure 9:
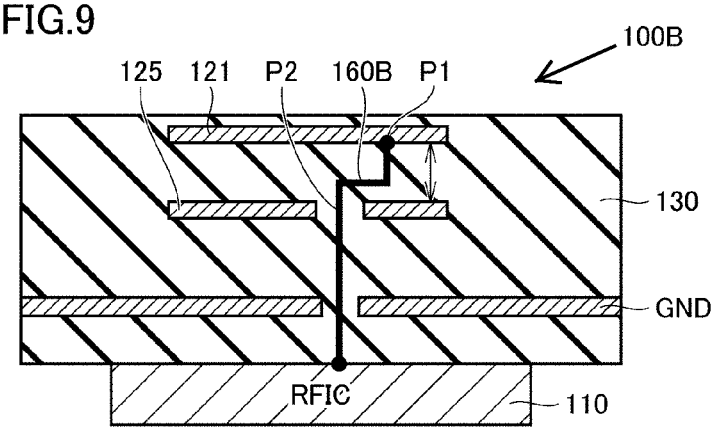
FIG. 9 is a cross-sectional view of an antenna module according to Modification 2.

In an antenna module 100B of Modification 2 illustrated in FIG. 9, a feed wire 160B is offset in the layer between the feed element 121 and the parasitic element 125.

(Modification 3)

In Embodiment 1 and Modifications 1 and 2, the case is described in which the feed element 121 and the parasitic element 125 have substantially the same size.

In general, the resonant frequencies of the feed element 121 and the parasitic element 125 are determined by the size of each element. Roughly, there is a tendency that the larger the element size becomes, the lower the resonant frequency becomes, and the smaller the element size becomes, the higher the resonant frequency becomes. Accordingly, by adjusting the size of the feed element 121 and the size of the parasitic element 125, it is possible to adapt to the frequency of the target radio frequency signal.

Figure 10:
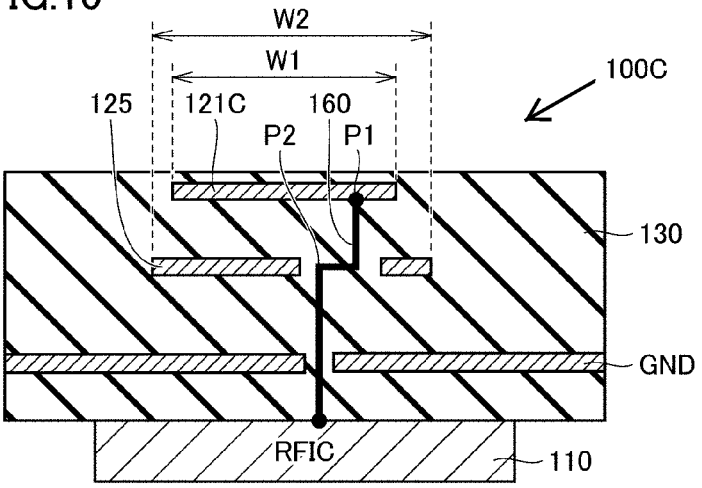
FIG. 10 is a cross-sectional view of an antenna module according to Modification 3.
Figure 11:
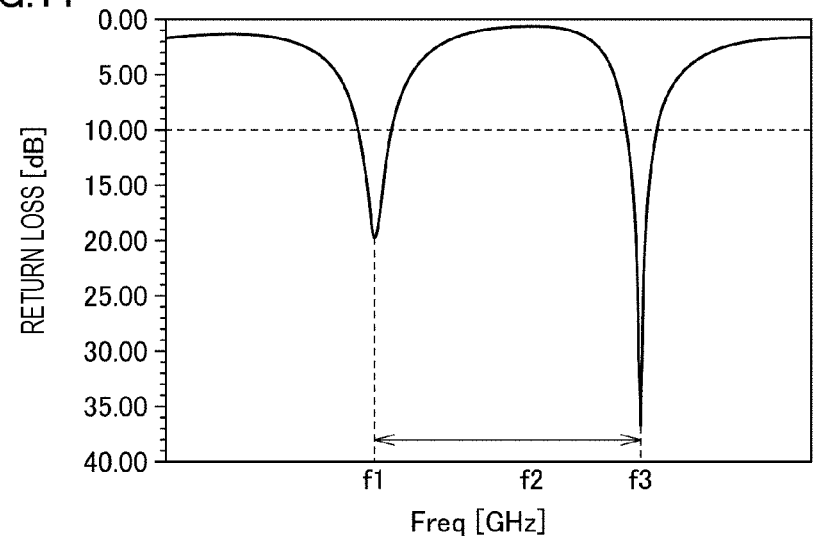
FIG. 11 is a diagram describing an example of a reflection characteristic of the antenna module according to Modification 3.

FIG. 10 is a cross-sectional view of an antenna module 100C according to Modification 3, and FIG. 11 is a diagram describing an example of a reflection characteristic of the antenna module 100C. In the antenna module 100C in FIG. 10, the feed element 121 in the antenna module 100 of Embodiment 1 illustrated in FIG. 2 is replaced by the feed element 121C. The feed element 121C has a size smaller than that of the parasitic element 125, and in the cross-sectional view of FIG. 10, the width W1 of the feed element 121C is set to be smaller than the width W2 of the parasitic element 125 (W1<W2). That is, the area of the radiation surface of the feed element 121C is smaller than the area of the radiation surface of the parasitic element 125, and when viewed in a plan view from the normal direction of the radiation surface (that is, the dielectric substrate), the feed element 121C is disposed to be inside of the parasitic element 125. Thus, as described in FIG. 11, the resonant frequency f3 of the feed element 121C is higher than the resonant frequency f2 of the antenna module 100 in FIG. 2.

Note that also in the antenna module 100C in FIG. 10, when viewed in a plan view from the normal direction of the dielectric substrate 130, the connection position P1 of the feed wire 160 in the feed element 121C is different from the penetration position P2 of the feed wire 160 in the parasitic element 125.

Although not illustrated in FIG. 11, when the size of the parasitic element 125 is further increased, the resonant frequency of the parasitic element 125 lowers, and therefore, it is possible to adapt to a radio frequency signal in a further lower frequency band.

Note that the size of the feed element 121C may be set larger than the size of the parasitic element 125. However, in the case where the entirety of the parasitic element 125 is covered by the feed element 121C when the antenna module 100C is viewed in a plan view from the normal direction of the dielectric substrate 130, there may be a state that the radio wave radiated from the parasitic element 125 is blocked by the feed element 121C and is not radiated correctly. Therefore, the element size of the feed element 121C disposed in the radiation direction of the radio frequency signal can be smaller than the size of the parasitic element 125.

In the case where the size of the feed element 121C is made larger than the size of the parasitic element 125, when the antenna module 100C is viewed in a plan view, it is required that the parasitic element 125 be disposed such that at least part thereof protrudes from the feed element 121C not to overlap with each other.

Embodiment 2

In Embodiment 1, there is described a single-polarized antenna module in which the number of the feed point of a feed element is one, however, it is possible to apply the features described in Embodiment 1 to a dual-polarized feed element capable of radiating two polarized waves from a one feed element.

Figure 12:
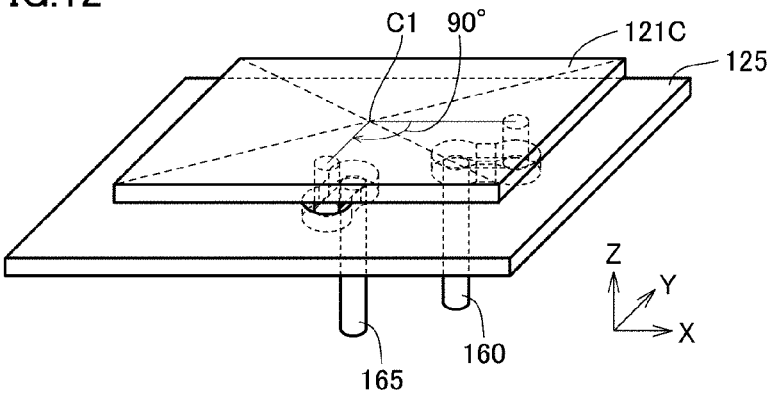
FIG. 12 is a perspective view for describing positions of a feed element and feed wires in a dual-polarized antenna module according to Embodiment 2.

FIG. 12 is a perspective view for describing positions of radiating elements and feed wires in a dual-polarized antenna module according to Embodiment 2. Note that, in FIG. 12, a case in which the size of the feed element is smaller than the size of the parasitic element, such as in Modification 3 is illustrated as an example, however, the size of the feed element and the size of the parasitic element may be substantially the same as those in FIG. 2 and the like.

The feed wire 160 rises from an RFIC (not illustrated), and is offset in the positive direction of an X-axis in FIG. 12 in the layer in which the parasitic element 125 is formed, and further rises toward the feed element 121C. On the other hand, a feed wire 165 for radiating another polarized wave is disposed at a position where the feed wire 160 is rotated by −90° around a Z-axis in FIG. 12 with respect to the center Cl of the diagonal lines of the rectangular feed element 121C. In more detail, the feed wire 165 rises from an RFIC (not illustrated), and is offset in the negative direction of a Y-axis in the layer in which the parasitic element 125 is formed, and further rises toward the feed element 121C.

Also, in Embodiment 2, the penetrating positions of the feed wires 160 and 165 in the parasitic element 125 and the feed points of the feed wires 160 and 165 in the feed element 121C are shifted from each other, and thus, it is possible to adjust the pass band width.

Figure 13:
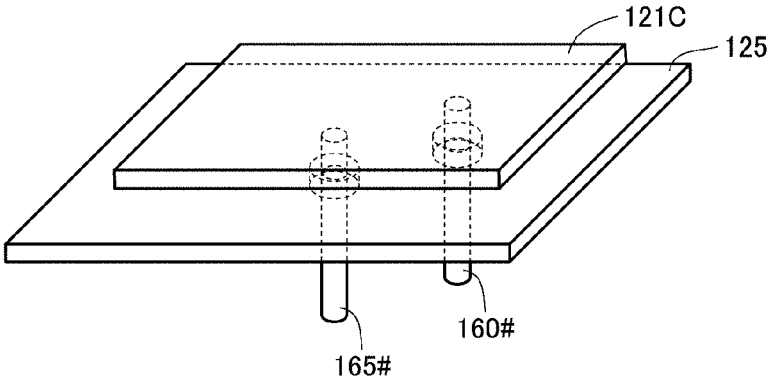
FIG. 13 is a perspective view for describing positions of radiating elements and feed wires in an antenna module according to Comparative Example 2.

In the antenna module capable of radiating two polarized waves, it is suitable to secure isolation between the two feed wires. Next, the above-described antenna module is compared with the dual-polarized antenna module in which the offset of the feed wire is not provided as illustrated in FIG. 13 (Comparative Example 2) with respect to isolation characteristic. In FIG. 13, both of the feed wires 160 # and 165 # corresponding to the feed wires 160 and 165 rise from an RFIC (not illustrated), penetrate through the parasitic element 125, and linearly rise to the feed element 121C.

Figure 14:
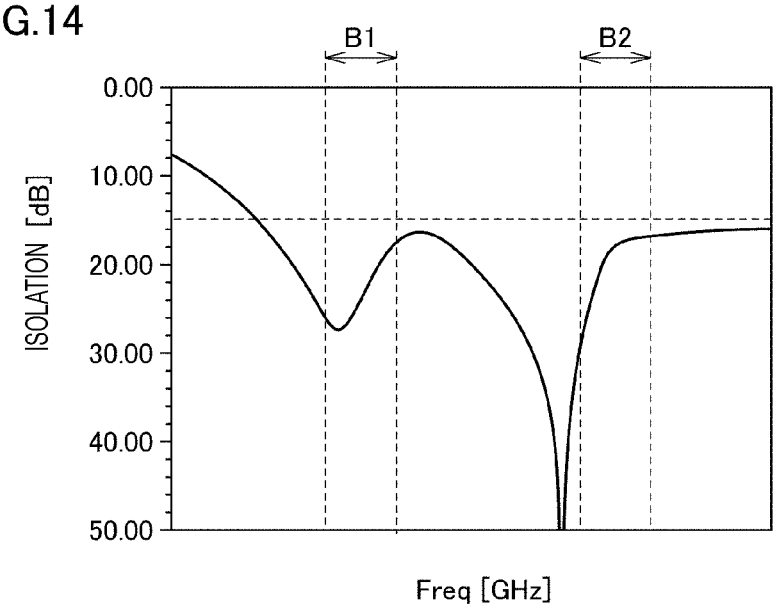
FIG. 14 is a diagram describing an example of an isolation characteristic between feed wires in the antenna module of Comparative Example 2.
Figure 15:
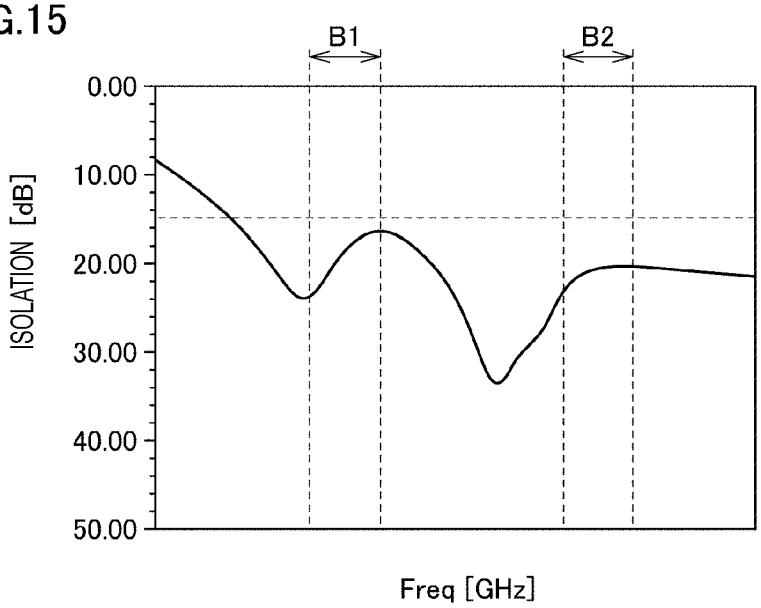
FIG. 15 is a diagram describing an example of an isolation characteristic between feed wires in the antenna module of Embodiment 2.

FIG. 14 is a diagram describing an isolation characteristic between the feed wire 160 # and the feed wire 165 # in Comparative Example 2, and FIG. 15 is a diagram describing an isolation characteristic between the feed wire 160 and the feed wire 165 in Embodiment 2. In FIG. 14 and FIG. 15, the horizontal axis represents frequency, and the vertical axis represents isolation between one and the other of the feed wires. Further, B1 represents a pass band width of the parasitic element 125, and B2 represents a pass band width of the feed element 121C.

With respect to the parasitic element 125, in FIG. 12 and FIG. 13, positions at which the feed wires penetrate through the parasitic element 125 are not changed. Therefore, comparing FIG. 14 with FIG. 15, there is no significant change in values of the isolation in the pass band width B1 of the parasitic element 125, and the values are in substantially the same level.

On the other hand, in the case of FIG. 15 where the position of the connection point (feed point) of the feed wire to the feed element 121C is offset as illustrated in FIG. 12, the isolation of the feed element 121C in the pass band width B2, especially in a radio frequency side, is improved as compared with the case of FIG. 14 where there is no offset.

This improvement in the isolation characteristic is due to the fact that the distance between the two feed points in the case of FIG. 12 with offset is longer than the distance between the two feed points in FIG. 13 without necessarily an offset. Therefore, when the two feed wires are offset to the inner side direction of the parasitic element 125, the distance between the two feed points becomes short, and thus the isolation characteristic is deteriorated.

In this way, in the dual-polarized antenna module, it is possible to adjust the isolation characteristic between the feed wires by offsetting the feed wires in the direction in which the distance between the feed points in the feed element increases.

Embodiment 3

In order to adjust the impedance of the radio frequency circuit, it is generally known to provide a stub to a transmission line.

In Embodiment 3, a description will be given of a configuration to widen the pass band width of the feed element and the parasitic element by providing a stub to the feed wire in the antenna module described in Embodiments 1 and 2.

Figure 16:
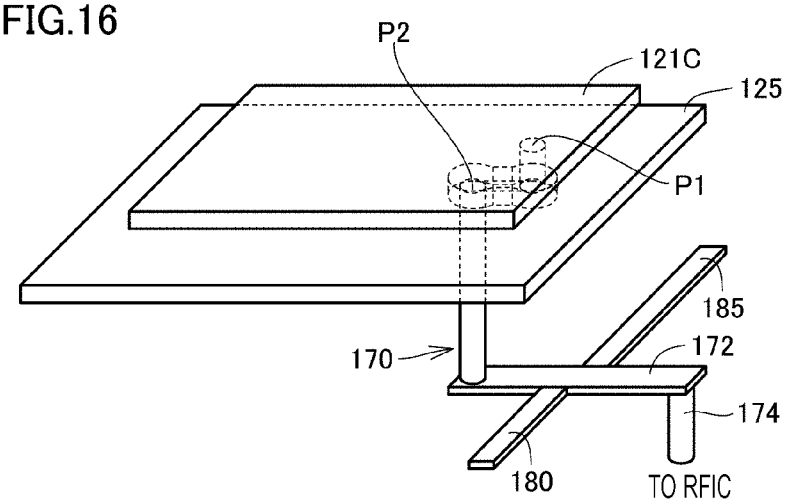
FIG. 16 is a perspective view for describing positions of radiating elements and a feed wire in an antenna module having stubs according to Embodiment 3.

FIG. 16 is a perspective view for describing the positions of the radiating elements and the feed wire of the antenna module according to Embodiment 3. In FIG. 16, illustrated is an example in which the feed element 121C having a size smaller than that of the parasitic element 125 is included as in the antenna module 100C described in Modification 3 of Embodiment 1 (FIG. 10), but the feed element and the parasitic element may have substantially the same size as illustrated in FIG. 2 and FIG. 3 and the like.

According to FIG. 16, in the antenna module according to Embodiment 3, a feed wire 170 falls from the layer in which the parasitic element 125 is formed, passes through a wiring pattern 172 formed in the layer between the parasitic element 125 and the ground electrode GND, and is further connected to the RFIC 110 through a via 174. Then, stubs 180 and 185 are connected to the wiring pattern 172.

Figure 17:
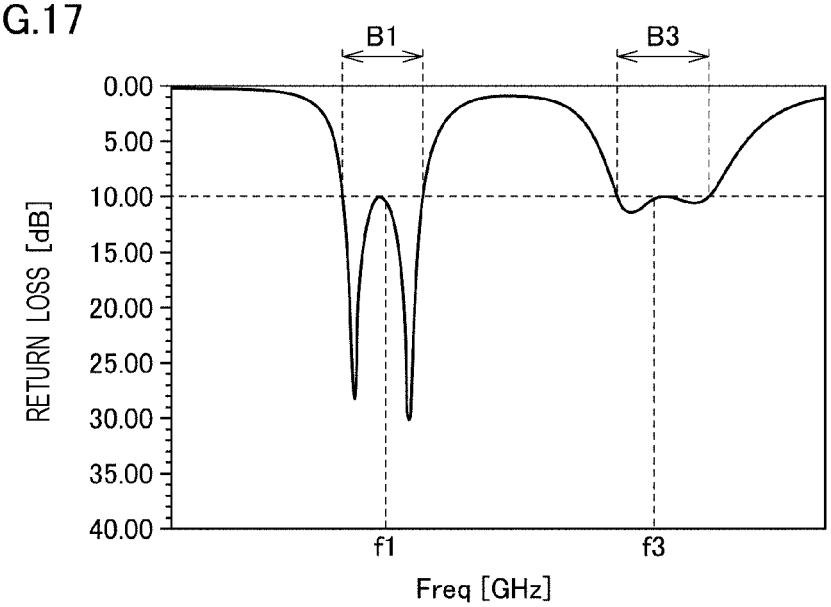
FIG. 17 is a diagram describing an example of a reflection characteristic of the antenna module of Embodiment 3.

The line length of the stubs 180 and 185 are set corresponding to the respective resonant frequencies of the feed element 121C and the parasitic element 125. By adjusting the impedance by the stubs 180 and 185, as described in the graph of the reflection characteristic of FIG. 17, it is possible to decrease the return loss at frequencies near the resonant frequency f1 of the parasitic element 125 and the resonant frequency f3 of the feed element 121C. As the result, it is possible to widen the pass band width B1 near the resonant frequency f1 and the pass band width B3 near the resonant frequency f3, as compared with the case in Modification 3 of Embodiment 1 in which the stubs are not provided (FIG. 10 and FIG. 11).

Figure 18:
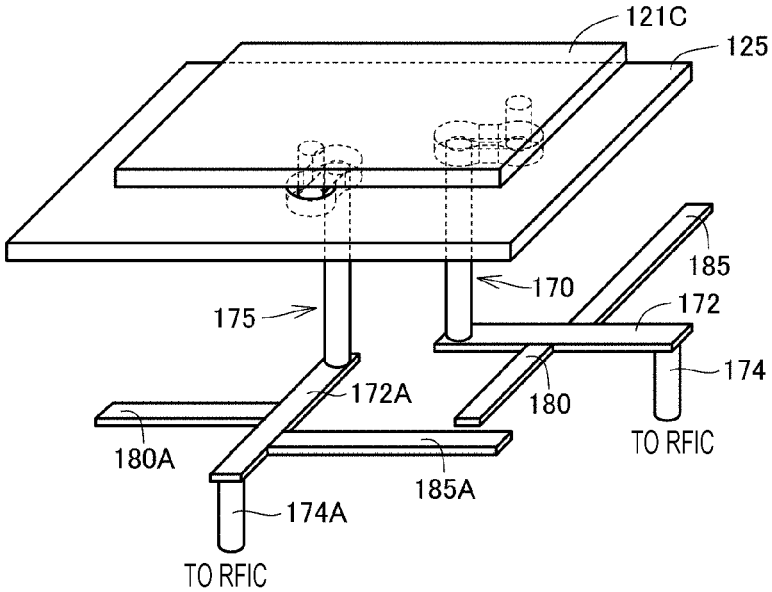
FIG. 18 is a perspective view for describing positions of radiating elements and feed wires in a dual-polarized antenna module with stubs according to Embodiment 3.

In FIG. 16, the case of the single-polarized antenna module is described, but the widening of the pass band width with the installation of the stub is also applicable to the dual-polarized antenna module of Embodiment 2 (FIG. 18). According to FIG. 18, a feed wire 175 for another polarization passes through a wiring pattern 172A and is connected to the RFIC 110 through a via 174A. Then, stubs 180A and 185A are connected to the wiring pattern 172A.

Note that, in the above-described embodiment, an example has been described in which the RFIC 110 is mounted on the second surface 132 in the opposite side of the first surface 134 of the dielectric substrate 130. However, the RFIC 110 may be disposed on the first surface 134. In this case, the feed wire 160 go through the layer between the parasitic element 125 and the ground electrode GND from the first surface 134, and rises to the layer in which the parasitic element 125 is formed.

In the above description, an example has been described in which the number of parasitic elements through which the feed wire passes is one, but the number of parasitic elements is not limited to this, and two or more parasitic elements may be disposed. Note that, as in the above-described embodiment, in the case of aspect in which the radio frequency signals in different frequency bands are radiated from the feed element and the parasitic element using the respective feed wires, it is desirable that the number of the parasitic elements through which the feed wires pass be one.

It should be construed that the embodiments disclosed herein are illustrative in all respects and are not restrictive. The scope of the present disclosure is defined by the claims rather than the description of the above-described embodiments, and it is intended to include all modifications within the meaning and scope equivalent to the scope of the claims.

REFERENCE SIGNS LIST

10 COMMUNICATION DEVICE
121, 121C FEED ELEMENT
100, 100A to 100C ANTENNA MODULE
111A to 111D, 113A to 113D, and 117 SWITCH
112AR to 112DR LOW-NOISE AMPLIFIER
112AT to 112DT POWER AMPLIFIER
114A to 114D ATTENUATOR
115A to 115D PHASE SHIFTER
116 COMBINER/DIVIDER
118 MIXER
119 AMPLIFIER
120 ANTENNA ARRAY
125 PARASITIC ELEMENT
130 DIELECTRIC SUBSTRATE
160, 160A, 160B, 165, 170, 175 FEED WIRE
161, 163, 174, 174A VIA
162, 172, 172A WIRING PATTERN
180, 180A, 185, 185A STUB
GND GROUND ELECTRODE

The invention claimed is:

1. An antenna module comprising:
a dielectric substrate having a multilayer structure;
a feed circuit element in the dielectric substrate and supplied with a radio frequency power;
a ground electrode in the dielectric substrate;
a parasitic circuit element in a layer that is between the feed circuit element and the ground electrode; and
a first feed wire penetrating through the parasitic circuit element and supplying the radio frequency power to the feed circuit element,
wherein when the antenna module is viewed in a plan view from a normal direction of the dielectric substrate, at least part of the feed circuit element overlaps the parasitic circuit element,
wherein, in the plan view, a first position at which the first feed wire is connected to the feed circuit element is different than a second position at which the first feed wire reaches, from a side of the ground electrode, the layer in which the parasitic circuit element is located, and
wherein a bandwidth of a resonant frequency of the feed circuit element is based on the first position, and a bandwidth of a resonant frequency of the parasitic circuit element is based on the second position.

2. The antenna module according to claim 1, wherein when the antenna module is viewed in the plan view, the first position is shifted toward an outer side direction of the parasitic circuit element relative to the second position.

3. The antenna module according to claim 2, wherein the first feed wire is offset in a layer that is between the parasitic circuit element and the feed circuit element.

4. The antenna module according to claim 1, wherein when the antenna module is viewed in the plan view, the first position is shifted toward an inner side direction of the parasitic circuit element relative to the second position.

5. The antenna module according to claim 4, wherein the first feed wire is offset in a layer that is between the parasitic circuit element and the feed circuit element.

6. The antenna module according to claim 1, wherein:
an area of the feed circuit element is smaller than an area of the parasitic circuit element, and
when the antenna module is viewed in the plan view, the feed circuit element is inside the parasitic circuit element.

7. The antenna module according to claim 1, further comprising:
a power feeding circuit mounted on the dielectric substrate and configured to supply the radio frequency power to the feed circuit element.

8. The antenna module according to claim 7, further comprising:
at least one stub connected to the first feed wire between the parasitic circuit element and the power feeding circuit.

9. A communication device comprising the antenna module according to claim 1.

10. An antenna module comprising:
a dielectric substrate having a multilayer structure;
a feed circuit element in the dielectric substrate and supplied with a radio frequency power;

a ground electrode in the dielectric substrate;

a parasitic circuit element in a layer that is between the feed circuit element and the ground electrode; and a first feed wire penetrating through the parasitic circuit element and supplying the radio frequency power to the feed circuit element, wherein when the antenna module is viewed in a plan view from a normal direction of the dielectric substrate, at least part of the feed circuit element overlaps the parasitic circuit element, wherein, in the plan view, a first position at which the first feed wire is connected to the feed circuit element is different than a second position at which the first feed wire reaches, from a side of the ground electrode, the layer in which the parasitic circuit element is located, and wherein the first feed wire is offset in the layer in which the parasitic circuit element is located, or the first feed wire is offset in the layer in which the parasitic circuit element is located.

11. An antenna module comprising:

a dielectric substrate having a multilayer structure;

a feed circuit element in the dielectric substrate and supplied with a radio frequency power;

a ground electrode in the dielectric substrate;

a parasitic circuit element in a layer that is between the feed circuit element and the ground electrode; and a first feed wire penetrating through the parasitic circuit element and supplying the radio frequency power to the feed circuit element, a second feed wire that penetrates through the parasitic circuit element and that supplies the radio frequency power to the feed circuit element, wherein when the antenna module is viewed in a plan view from a normal direction of the dielectric substrate, at least part of the feed circuit element overlaps the parasitic circuit element, wherein, in the plan view, a first position at which the first feed wire is connected to the feed circuit element is different than a second position at which the first feed wire reaches, from a side of the ground electrode, the layer in which the parasitic circuit element is located, and wherein when the antenna module is viewed in the plan view, a third position at which the second feed wire is connected to the feed circuit element is different than a fourth position at which the second feed wire reaches, from the side of the ground electrode, the layer in which the parasitic circuit element is located.

12. The antenna module according to claim 11, wherein when the antenna module is viewed in the plan view:

the first position is shifted toward an outer side direction of the parasitic circuit element relative to the second position, and the third position is shifted toward the outer side direction of the parasitic circuit element relative to the fourth position.

* * * * *